US007426356B2

(12) United States Patent
Ota

(10) Patent No.: US 7,426,356 B2
(45) Date of Patent: Sep. 16, 2008

(54) DEVELOPER CARTRIDGE, PRINT PROCESS CARTRIDGE, AND IMAGE FORMING APPARATUS

(75) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 30 days.

(21) Appl. No.: 11/458,766

(22) Filed: Jul. 20, 2006

(65) Prior Publication Data

US 2007/0031164 A1 Feb. 8, 2007

(30) Foreign Application Priority Data

Jul. 21, 2005 (JP) ..... 2005-210808

(51) Int. Cl.
*G03G 15/08* (2006.01)

(52) U.S. Cl. ..... 399/120

(58) Field of Classification Search ..... 399/119, 399/120, 262, 358, 360
See application file for complete search history.

(56) References Cited

U.S. PATENT DOCUMENTS

| | | | | |
|---|---|---|---|---|
| 5,084,734 | A * | 1/1992 | Yoshino et al. | 399/262 |
| 5,109,254 | A | 4/1992 | Oka et al. | |
| 5,428,436 | A * | 6/1995 | Sundquist et al. | 399/120 X |
| 5,450,178 | A | 9/1995 | Kawashima et al. | |
| 6,363,233 | B1 * | 3/2002 | Nakajima | 399/120 |
| 6,904,249 | B2 * | 6/2005 | Kato et al. | 399/120 |
| 2004/0047651 | A1 * | 3/2004 | Koyama et al. | 399/120 |

FOREIGN PATENT DOCUMENTS

| | | | |
|---|---|---|---|
| EP | 1 659 456 | A2 | 5/2006 |
| JP | 01-296261 | A | 11/1989 |
| JP | 05-303311 | A | 11/1993 |
| JP | 2004-085894 | A | 3/2004 |

* cited by examiner

*Primary Examiner*—Sandra L Brase
(74) *Attorney, Agent, or Firm*—Panitch Schwarze Belisario & Nadel LLP

(57) ABSTRACT

A developer cartridge holds developer that is supplied into a print process cartridge of an image forming apparatus. The developer cartridge includes a fresh developer chamber and a waste developer chamber. The fresh developer chamber holds fresh developer in it. The waste developer chamber holds waste developer in it. An inlet is formed in the waste developer chamber. The waste developer is received through the inlet into the waste developer chamber. A first opening-and-closing member opens and closes the inlet. A mechanism drives the first opening-and-closing member to open the inlet when an operating member is positioned to a first position after the developer cartridge is attached to the print process cartridge. The mechanism driving the first opening-and-closing member to close the inlet when the operating member is positioned to a second position before the developer cartridge is detached from the print process cartridge.

11 Claims, 17 Drawing Sheets

FIG.13A *(Prior Art)*
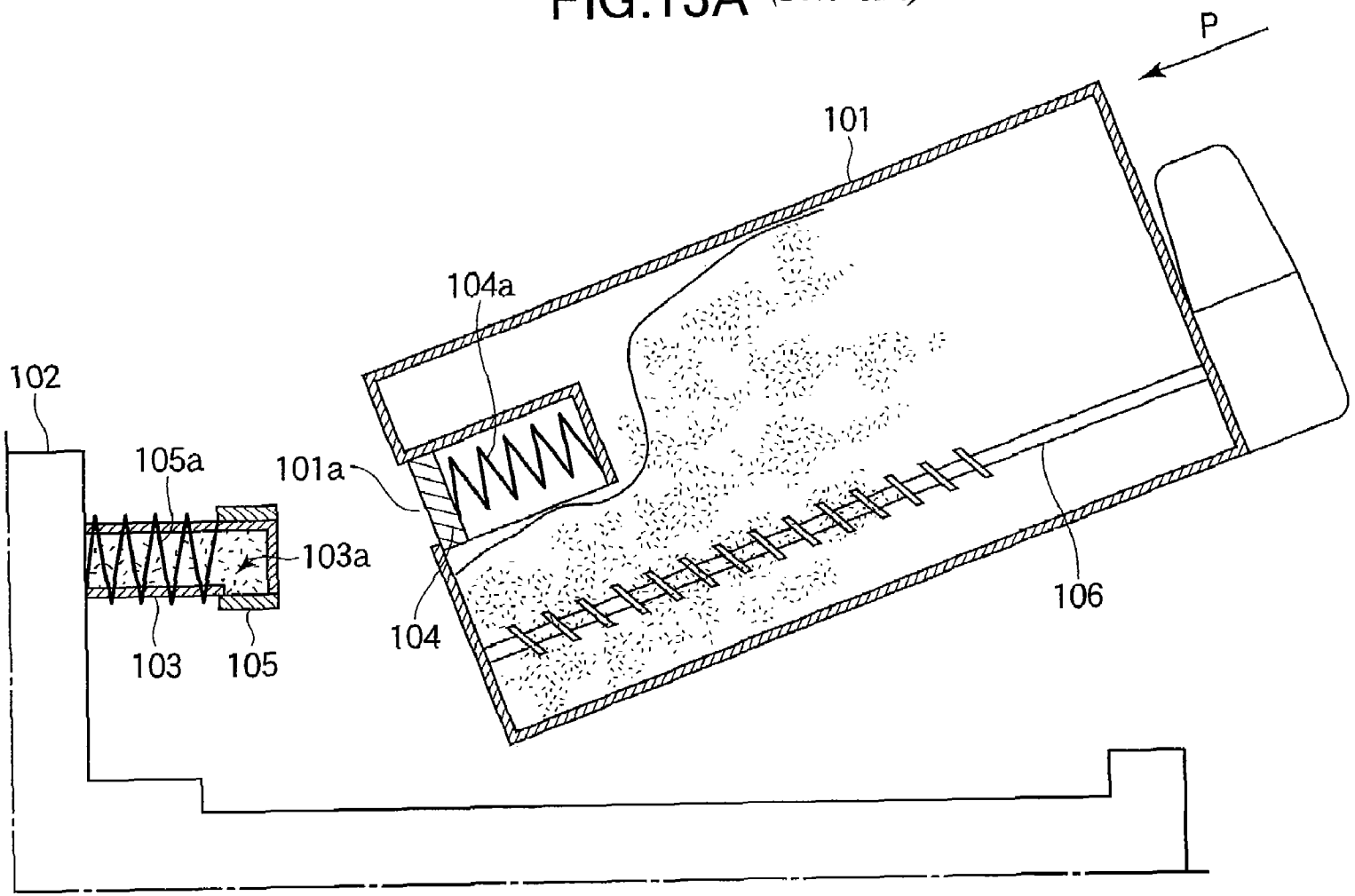

FIG.13B *(Prior Art)*
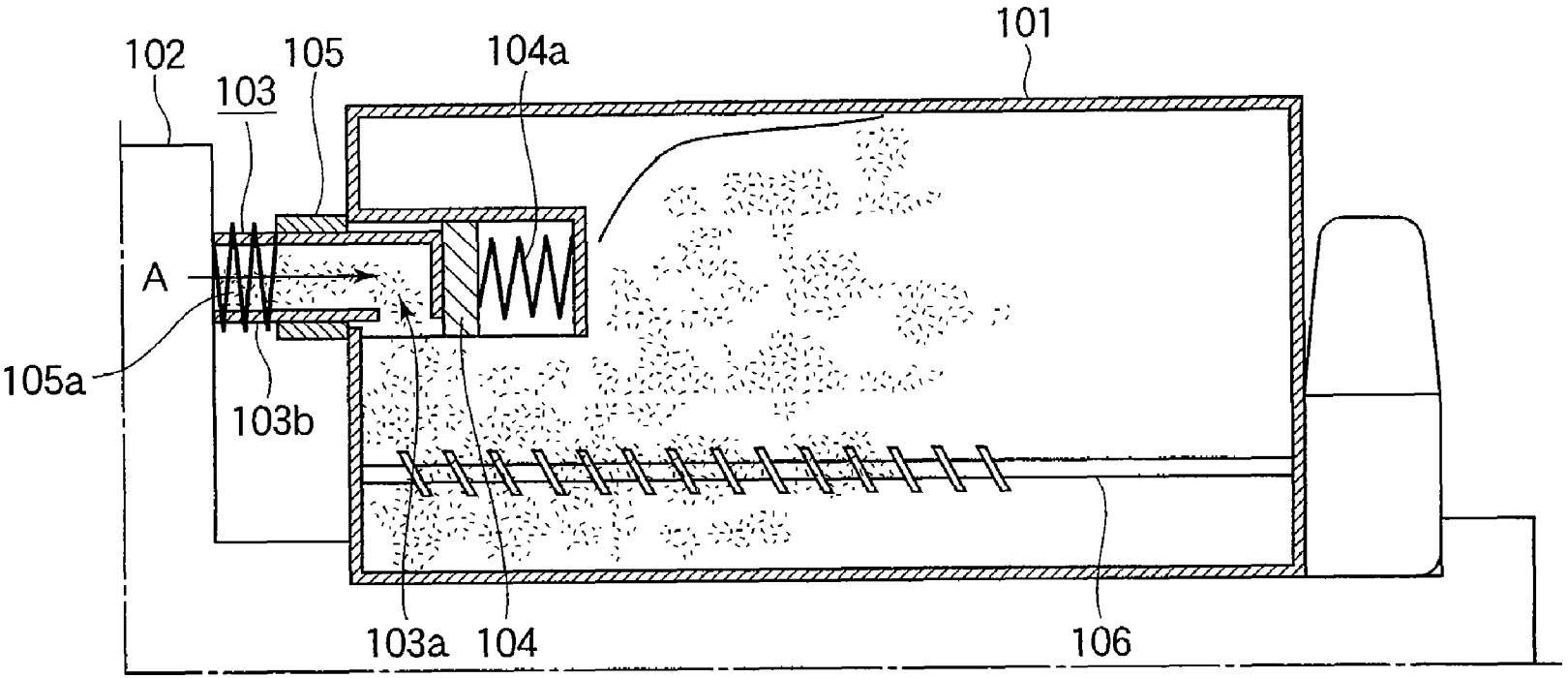

FIG.13C *(Prior Art)*
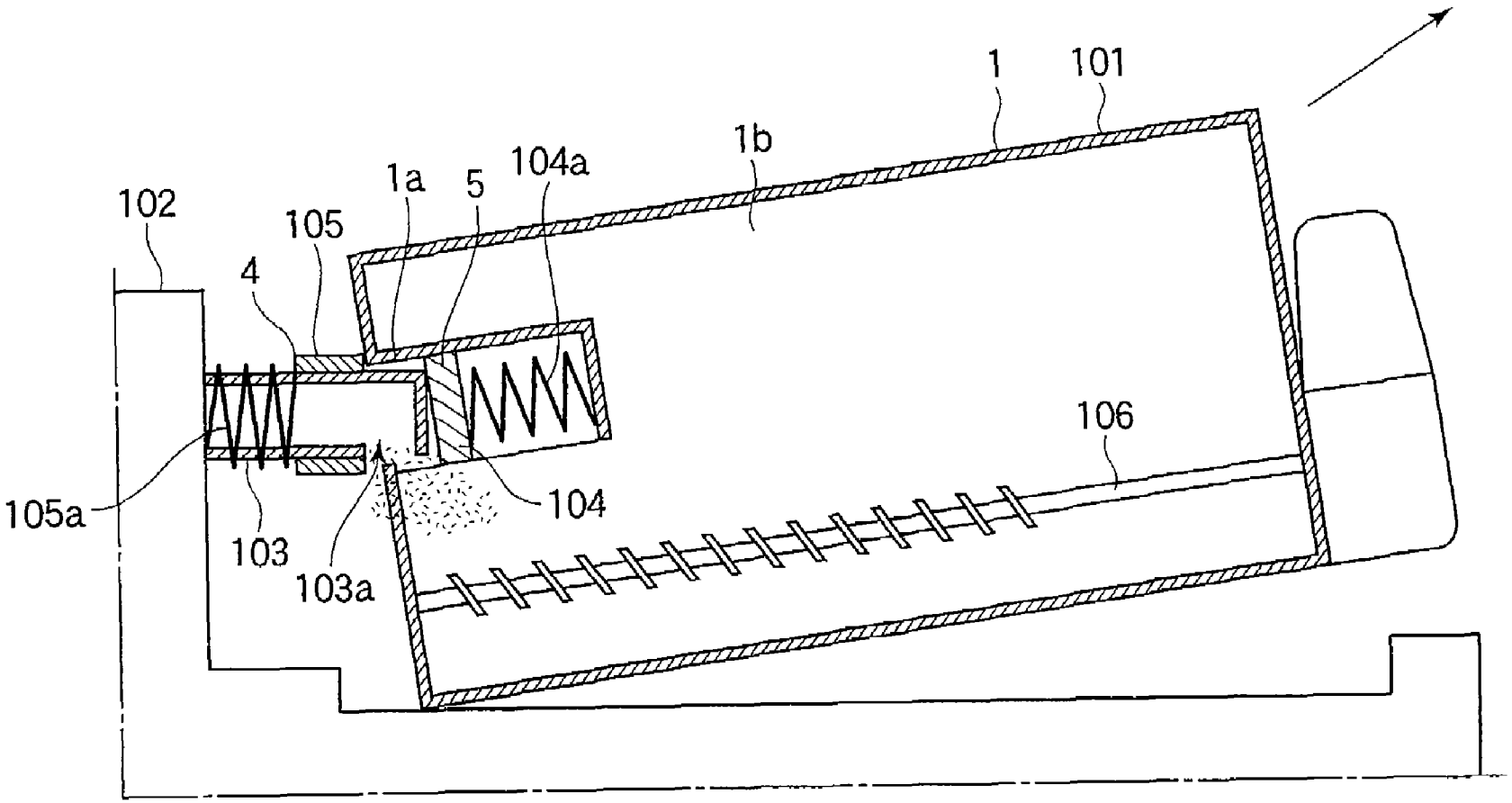

FIG.14A *(Prior Art)*
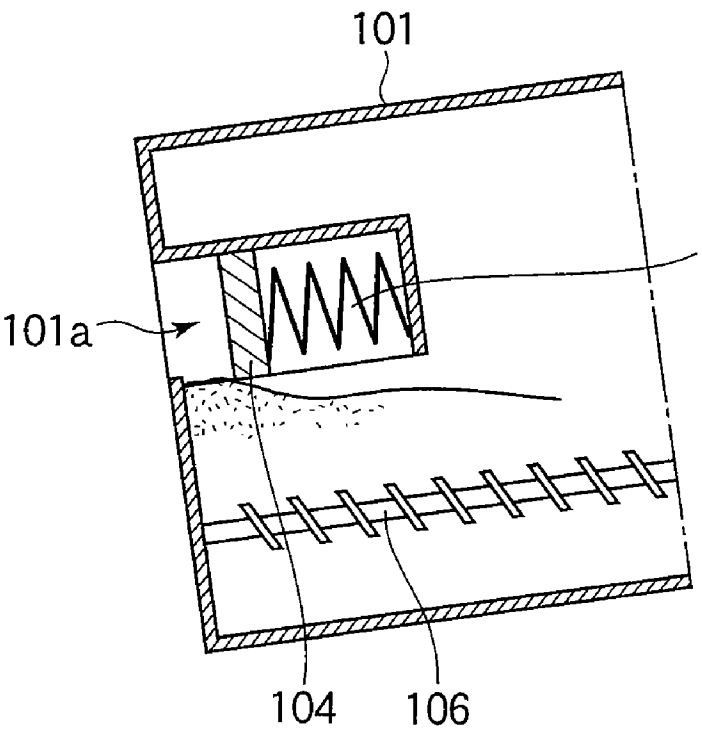
FIG.14B *(Prior Art)*
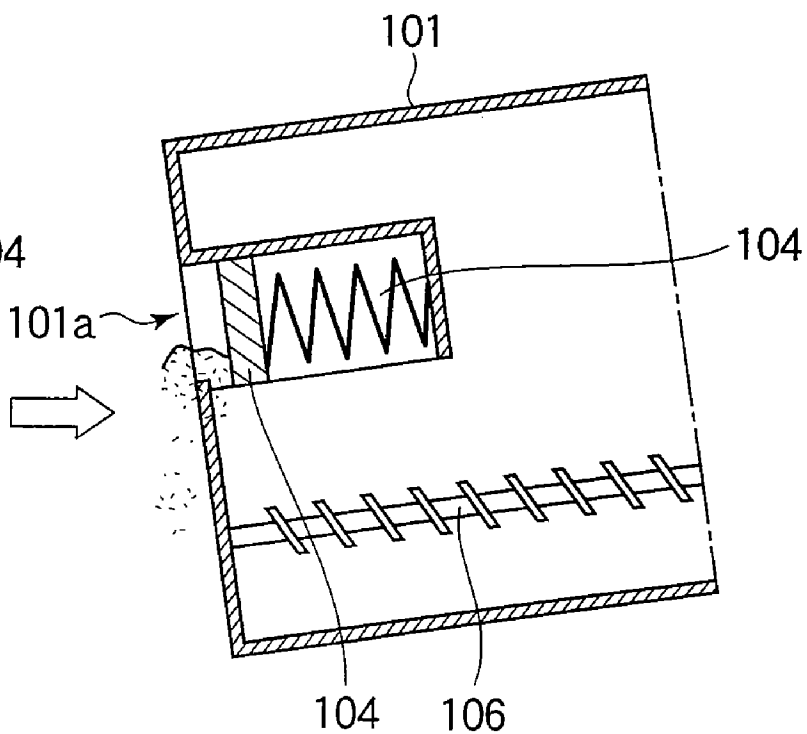

DEVELOPER CARTRIDGE, PRINT PROCESS CARTRIDGE, AND IMAGE FORMING APPARATUS

BACKGROUND OF THE INVENTION

1. Field of the Invention

The present invention relates to a developer cartridge, a print process cartridge, and an image forming apparatus.

2. Description of the Art

Electrophotographic process is performed in a conventional image forming apparatus such as an electrophotographic printer, a copying machine, or a facsimile machine. A charging unit charges a circumferential surface of an image bearing body. An exposing unit such as a light emitting diode head (LED head) illuminates the charged circumferential surface of the image bearing body to form an electrostatic latent image. A developing unit supplies developer to the electrostatic latent image to develop it with the developer into a developer image. The developer image is transferred onto paper that is being advanced. The paper then enters a fixing unit where the developer image is fixed into a permanent image. Some of the developer may remain on the image bearing body after transfer of the developer image onto the paper. The residual developer is removed by a cleaning blade. A waste developer collecting unit transports the residual developer removed from the image bearing body. The residual developer is finally collected as a waste developer into a developer cartridge.

Such a conventional developer cartridge includes a fresh developer chamber that holds fresh developer to be supplied into a print process cartridge of the image forming apparatus and a waste developer chamber that holds the waste developer. Japanese patent publication (KOKAI) No. 2004-85894 discloses this type of developer cartridge and an image forming apparatus to which the developer cartridge is attached.

FIG. 13A illustrates a generally cylindrical developer cartridge 101 immediately before it is mounted to the print process cartridge 102.

The developer cartridge 101 includes a lid 104 that opens and closes an opening 101*a* from the inside of the developer cartridge 101, and a spring 104*a* that urges the lid 104 toward the opening 101*a*. The spring 104*a* has one end fixed to an inner wall that defines the opening 101*a* and another end fixed to the lid 104, and urges the lid 104 against the wall of the developer cartridge to close the opening 101*a*.

FIG. 13B illustrates the print process cartridge 102 shortly after it is mounted to the print process cartridge 102. The print process cartridge 102 includes a waste developer discharging cylinder 103 to which the developer cartridge 101 is attached. The waste developer is collected into the developer cartridge 101 through the waste developer discharging cylinder 103. The discharging mechanism 103 includes an opening 103*a* through which the waste developer is discharged into the developer cartridge 101, a lid 105 that fits over the discharging cylinder 103*b* and is slidable in an axial direction of the discharging cylinder 103*b*. A spring 105*a* is mounted to the discharging cylinder 103 and urges the lid 105 toward a free end of the discharging cylinder 103*b*.

The opening 101*a* of the developer cartridge 101 is a cylindrical hole having an inner diameter slightly larger than an outer diameter of the discharging cylinder 103*b*. When the developer cartridge 101 is out of the print process cartridge 102, the lid 104 closes the opening 101*a* of the developer cartridge 101 and the lid 105 closes the discharges cylinder 103*b* of the print process cartridge 102. Specifically, the spring 104*a* urges the lid 104 to close the opening 101*a* while the spring 105*a* urges the lid 105 to close the opening in the discharging cylinder 103*b*, so that the developer held in the developer cartridge 101 and in the discharging cylinder 103*b* is prevented from leaking out.

Prior to attachment of the developer cartridge to the print process cartridge 102, the developer cartridge 101 is tilted at an angle and is attached to the print process cartridge 102 so that the discharge cylinder 103*b* enters the opening 101*a*. Then, a user moves the developer cartridge 101 in a direction shown by arrow P to fit to the print process cartridge 102. At this moment, the side wall of the developer cartridge 101 pushes the lid 105 away from the free end in the axial direction of the discharging cylinder 103*b*, causing the opening 103*a* to be exposed. Then, as the user moves the developer cartridge 101 further, the discharging cylinder 103*b* enters the developer cartridge 101 through the opening 101*a*. The tip of the discharging cylinder 103*b* causes the lid 104 to slide into the developer cartridge 101 against the urging force of the spring 104*a*.

As described above, the developer cartridge 101 is mounted to the print process cartridge 102. As shown in FIG. 13B, as long as the developer cartridge 101 remains attached to the print process cartridge 102, both the opening 101*a* and the opening 103*a* remain open. Thus, the waste developer in the discharging cylinder 103*b* is transported in a direction shown by arrow A (FIG. 13B), and falls into the developer cartridge 101 through the opening 103*a*. A spiral 106 transports the waste developer toward a far end of the developer cartridge 101.

FIG. 13C illustrates the cylindrical developer cartridge 101 when it is being detached from the print process cartridge 102.

When the developer cartridge 101 is detached from the print process cartridge 102, the developer cartridge 101 is first tilted at an angle with a horizontal direction, and is then pulled in a direction shown by arrow Q in FIG. 13C. When the developing cartridge 101 is pulled farther away from the print process cartridge 102, the urging force of the spring 104*a* causes the lid 104 to close the opening 101*a* and opening 103*a* while the urging force of the spring 105*a* causes the lid 105 to close the opening 103*a*.

As described above, the developer cartridge 101 is tilted before it is detached from the print process cartridge 102.

FIGS. 14A and 14B illustrate the conventional developer cartridge 101 when the developer cartridge 101 is taken out of the print process cartridge 102.

Due to the inclination of the developer cartridge 101, the waste developer in the developer cartridge 101 tends to move toward the opening 101*a* and piles up in the vicinity of the opening 101*a*. If the waste developer reaches the lid 104, the waste developer will be pushed out of the developer cartridge 101.

SUMMARY OF THE INVENTION

The present invention was made in view of the aforementioned problem.

An object of the invention is to provide a developer cartridge in which the waste developer will not spill out of the developer cartridge when the developer cartridge is detached from the print process cartridge.

Another object of the invention is to provide a print process cartridge to which the developer cartridge is attached.

Still another object of the invention is to provide an image forming apparatus to which the print process cartridge is attached.

A developer cartridge holds developer. The developer cartridge includes a fresh developer chamber, a waste developer chamber, an inlet, a first opening-and-closing member, and a mechanism. The fresh developer chamber holds fresh developer. The waste developer chamber holds waste developer. The inlet is formed in the waste developer chamber, the waste developer being received through the inlet into the waste developer chamber. The first opening-and-closing member opens and closes the inlet. The mechanism drives the first opening-and-closing member to open the inlet.

The developer cartridge further includes an opening and a second opening-and-closing member. The opening is formed in the fresh developer chamber through which the fresh developer is discharged from the fresh developer chamber. The second opening-and-closing member opens and closes the opening.

The mechanism causes the second opening-and-closing member and the first opening-and-closing member to open and close in an interlocked relation.

The mechanism operates in such a way that the first and second opening-and-closing members close the inlet and the opening, respectively, when the operating member is at a first position, and that the first and second opening-and-closing members open the inlet and the opening, respectively, when the operating member is at a second position.

The mechanism causes the first opening-and-closing member to rotate through an angle about an axis when the mechanism drives the first opening-and-closing member.

The first opening-and-closing member includes a shaft, a gear attached to one end of the shaft, and a cap attached to another end of the shaft, wherein the mechanism transmits a drive force to the gear to drive the first opening-and-closing member in rotation about the shaft.

A print process cartridge forms an electrostatic latent image on an image bearing body and then develops the electrostatic latent image into a developer image. The print process cartridge includes a developer cartridge, a transporting mechanism, and a waste developer discharging port. The developer cartridge includes a fresh developer chamber that holds fresh developer and a waste developer chamber that holds waste developer unit on a recording medium. The transporting mechanism transports waste developer removed from the image bearing body.

The waste developer is supplied from the transporting mechanism into the waste developer chamber through waste developer discharging port. The developer cartridge includes an inlet, an opening-and-closing member, and a mechanism that drives the opening-and-closing member. The inlet is formed in the waste developer chamber, the waste developer being received into the waste developer chamber through the inlet. The opening-and-closing member opens and closes the inlet. The mechanism drives the opening-and-closing member to open and closes the inlet.

An image forming apparatus incorporates the developing apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIGS. 13A-13C illustrates a conventional developer cartridge and the print process cartridge that receives the developer cartridge; and FIGS. 14A and 14B illustrate the conventional developer cartridge and the print process cartridge when the developer cartridge is taken out of the print process cartridge.

DETAILED DESCRIPTION OF THE INVENTION

Embodiments will be described with reference to the accompanying drawings.

First Embodiment

{Construction}

Figure 1:
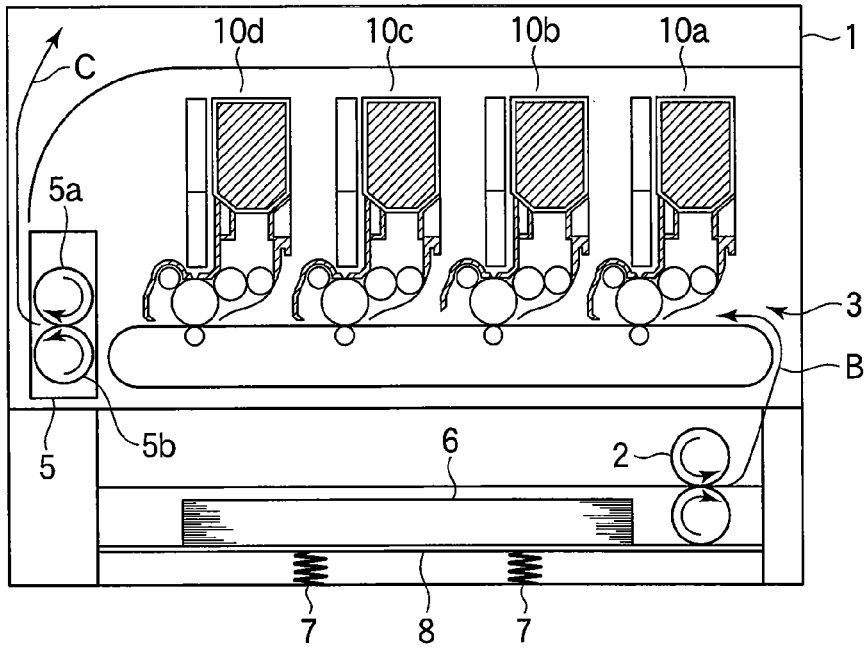
FIG. 1 is a cross-sectional view of an image forming apparatus according to a first embodiment.

FIG. 1 is a cross-sectional view of an image forming apparatus according to a first embodiment. An image forming apparatus 1 according to the first embodiment is a single-pass type electrophotographic color printer. A paper support platform 8 supports a stack of paper 6 on it. A spring 7 urges the paper support platform 8, so that the top page of the paper 6 is in pressure contact with a hopping roller 2. A transport unit 3 transports each page of the paper 6 in a direction shown by arrow B. A controller, not shown, converts image information received from an external image processing apparatus, not shown, into print information. Image forming sections 10*a*-10*d* form developer images of corresponding colors on the paper 6. The developer images of corresponding colors are transferred onto the paper 6 one over the other in registration as the paper 6 advances through the image forming sections 10*a*-10*d*. Then, the paper 6 passes through a fixing unit 5 where the developer images are fixed in to a permanent full color image. The paper 6 having the permanent image is then discharged onto a stacker.

The image forming sections 10*a*-10*d* are detachably attached to the image forming apparatus 1. The developer is supplied from a fresh developer chamber of a developer cartridge 12 (FIG. 2) and the waste developer is collected into a waste developer chamber of the developer cartridge 12.

The image forming sections 10*a*, 10*b*, 10*c*, and 10*d* employ an LED type exposing unit, and perform charging, exposing, developing, and transferring to form images of black, yellow, magenta, and cyan, respectively.

Figure 2:
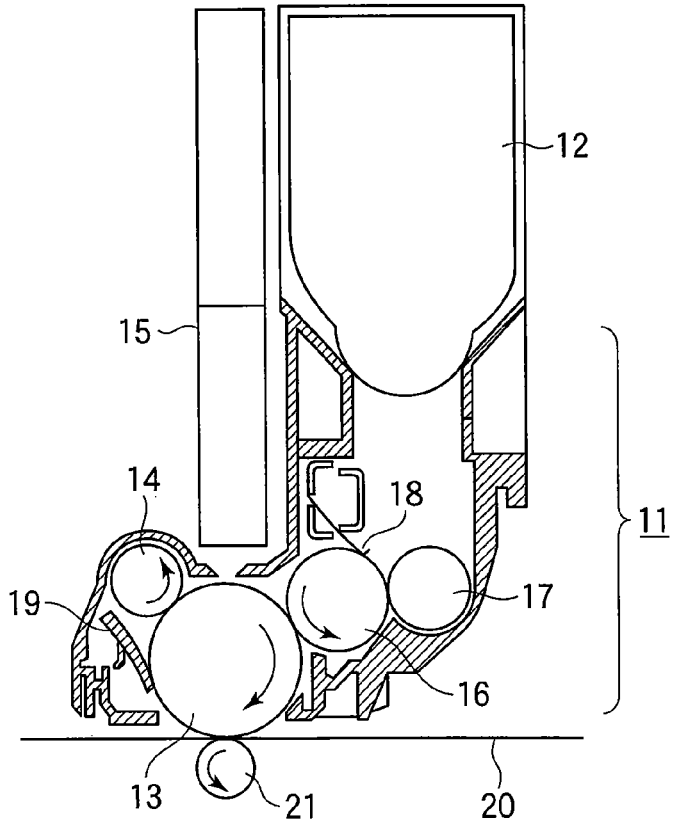
FIG. 2 illustrates one of image forming sections of the image forming apparatus.

FIG. 2 illustrates one of the image forming sections 10*a*-10*d*.

Each of the image forming sections 10*a*-10*d* includes the developer cartridge 12 and a print process cartridge 11. A charging roller 14 charges a circumferential surface of an image bearing body 13. An exposing unit 15 illuminates the charged surface of the image bearing body 13 to form an electrostatic latent image. A developing roller 16 supplies the developer to the electrostatic latent image formed on the image bearing body 13. A developer supplying roller 17 supplies the developer to the developing roller 16. A developing blade 18 is in pressure contact with the circumferential surface of the developing roller 16, and forms a thin layer of developer when the developing roller 16 rotates. A cleaning device 19 removes residual developer from the circumferential surface of the image bearing body 13 after transfer.

A transfer belt 20 is disposed under the image forming section 10*a*. A transfer roller 21 is disposed beneath the transfer belt 20. A bias voltage having an opposite polarity to the image bearing body 13 is applied to the transfer roller 21. The transfer belt 20 is a part of the transport unit 3, and runs in sandwiched relation between the image bearing body 13 and the transfer roller 21. The transfer belt 20 is charged by a charging means, not shown, and attracts the paper 6 to transport the paper 6 through the image forming section 10*a*.

Just before the paper 6 arrives at the image forming section 10*a*, the exposing unit 15 begins to illuminate the charged surface of the image bearing body 13 to form an electrostatic latent image. The developing section supplies the developer to the electrostatic latent image, thereby forming a developer image. As the paper 6 enters a transfer point defined between the image bearing body 13 and the transfer roller 21, the developer image is transferred onto the paper 6 with the aid of a bias voltage applied to the transfer roller 21. The aforementioned electrophotographic process is performed in each of the image forming sections 10*a*-10*d*.

The fixing unit 5 is located downstream of the image forming section 10*d*, and includes a fixing roller 5*a* and a pressure roller 5*b* that cooperate with each other to hold the paper 6 between them and transport through the fixing unit 5. A heater, not shown, heats the fixing roller 5*a* so that the developer images of the respective colors on the paper 6 are fused by heat and pressure into a permanent full color image. After fixing, the paper 6 is further transported by a transporting mechanism, not shown, in a direction shown by arrow C (FIG. 1) and is discharged onto a stacker defined on top of the image forming apparatus 1.

Figure 3:
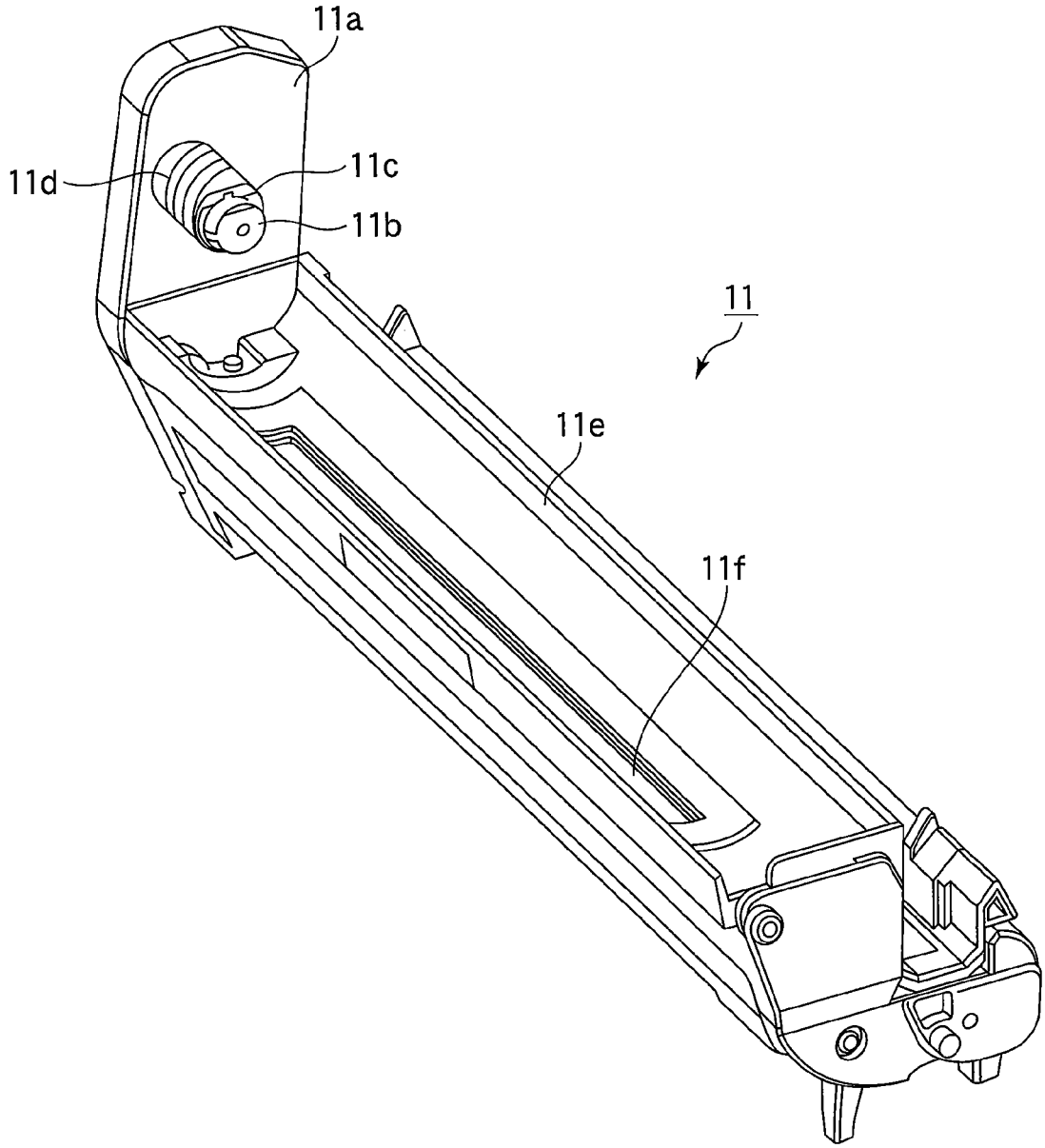
FIG. 3 is a perspective view illustrating a print process cartridge.

FIG. 3 is a perspective view illustrating the print process cartridge 11.

A transporting section 11*a* transports the waste developer, and the waste developer is discharged through a discharging cylinder 11*b* into the developer cartridge 12, not shown. A cylindrical lid 11*c* fits over the discharging cylinder 11*b* and is movable along the discharging cylinder 11*b* to open and close the discharging cylinder 11*b*. A spring lid urges the lid 11*c* away from the transporting section 11*a* toward a free end of the discharging cylinder 11*b*. A case lie accommodates the image bearing body 3 and its surroundings in FIG. 2. The fresh developer is supplied into the print process cartridge through an opening 11*f*. The transporting section 11*a* transports the waste developer, removed by the cleaning device 19 from the image bearing body 13, into the discharging cylinder 11*b*. The discharging cylinder 11*b* has one end fixed to the transporting section 11*a*. The waste developer is discharged from the transporting section 11*a* into the discharging cylinder 11*b*. The lid 11*c* is provided in the vicinity of a free end of the discharging cylinder 11*b*, and prevents spillage of the waste developer through an opening, not shown.

A spring lid fit over the discharging cylinder 11*b* and extends across the lid 11*c* and the wall of the transporting section 11*a*. The spring lid urges the lid 11*c* in a direction away from the transporting section 11*a*, tending to close the opening 11*g* formed in the discharging cylinder 11*b*. The case lie accommodates the image bearing body 13, charging roller 14, developing roller 16, toner-supplying roller 17, blade 18, and cleaning device 19. The opening 11*f* is formed in the top portion of the case 11*e*. The fresh developer is discharged from the developer cartridge 12 through the opening formed in the developer cartridge 12, and enters the print process cartridge 11 through the opening 11*f*.

The transporting section 11*a* of the print process cartridge 11 transports the waste developer, removed by the cleaning device 19, into the middle of the discharging cylinder 11*b*, thereby feeding the waste developer into a waste developer chamber 30*b* of the developer cartridge 12.

Figure 4:
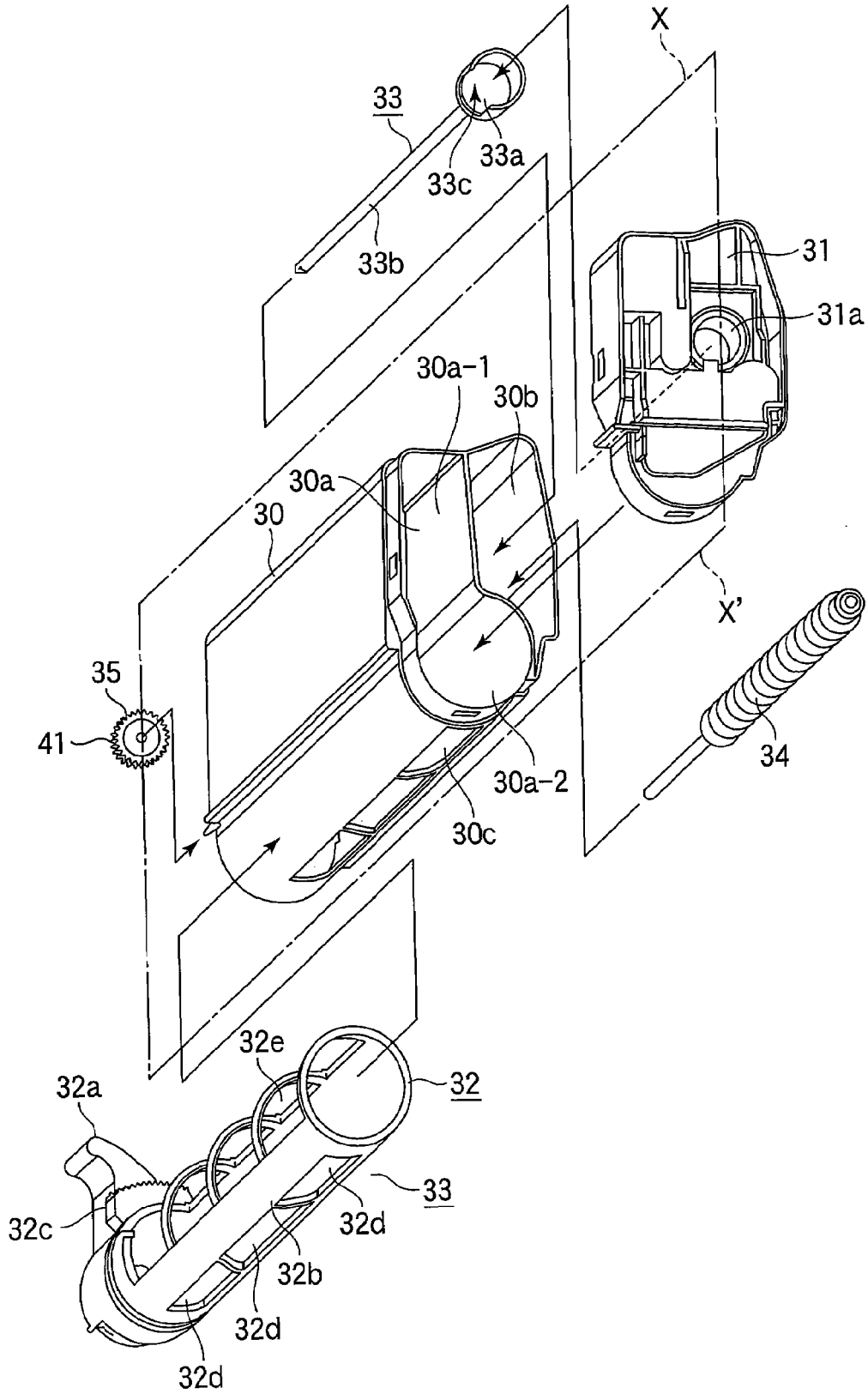
FIG. 4 is an exploded perspective view of a developer cartridge.

FIG. 4 is an exploded perspective view of the developer cartridge 12.

The developer cartridge 12 is detachably attached to the print process cartridge 11. A body 30 holds the developer in it. A side wall 31 closes one longitudinal end of the body 30. An inlet open/close member 33 is rotatable to open and close an inlet gate 31*a* formed in the side wall 31. A spiral 34 transports the waste developer in the body 30.

The body 30 includes two sealed chambers: a fresh developing chamber 30*a* that holds fresh developer and a waste developer chamber 30*b* that holds waste developer. The fresh developer 30*a* includes a long box-like upper body 30*a*-1 and a semi cylindrical lower body 30*a*-2. The upper body 30*a*-1 holds a large portion of the fresh developer and the lower body 30*a*-2 loosely receives the shutter 32. The lower body 30*a*-2 has a discharging opening 30*c* formed in its bottom. Specifically, when the developer cartridge 12 is attached into the print process cartridge 11 properly, the developer cartridge 12 can communicate with the print process cartridge 11 through the discharging opening 30*c*.

The user operates a lever 32*a* of the shutter 32 to rotate the shutter 32 relative to the semi cylindrical lower body 30*a*-2, thereby adjusting the amount of the developer supplied into the print process cartridge 11.

Figure 5:
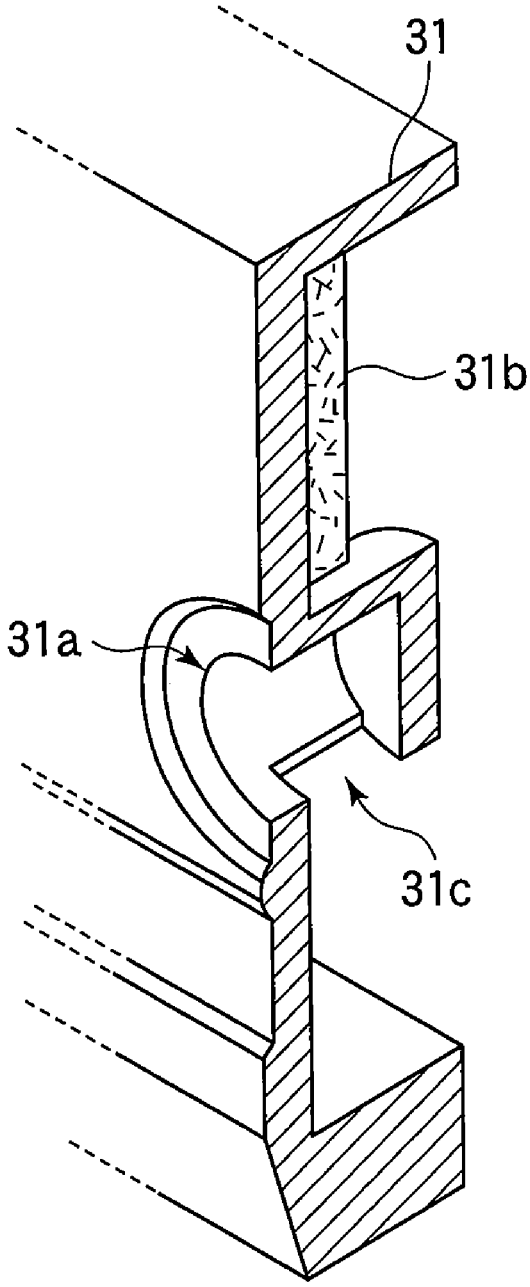
FIG. 5 is a fragmentary perspective view of a side wall.

FIG. 5 is a fragmentary perspective view of the side wall 31. The side wall 31 closes one longitudinal end of the body 30, and prevents leakage of the waste developer and fresh developer from their corresponding chambers. Referring to FIG. 5, the side wall 31 has an inlet gate 31*a* through which the waste developer is received into the waste developer chamber 30*b*. The inlet gate 31*a* is a generally cylindrical space one end of which opens to the outer surface of the side wall 31 and another end of which opens to the inner surface of the side wall 31. The another end is closed by a circular bottom plate. The inlet gate 31*a* has an inner diameter slightly larger than the outer diameter of the discharging cylinder 11*b* of the print process cartridge 11. The discharging cylinder 11*b* enters the inlet gate 31*a* when the developer cartridge 12 is attached to the print process cartridge 11. The inner circumferential wall of the inlet gate 31*a* is formed with an opening 31*c* through which the waste developer falls into the waste developer chamber 30*b*. The opening 31*c* preferably extends circumferentially through an angle less than 180°. The side wall 31 has a sealing member 31*b* that seals the gap between the fresh developer chamber 30*a* and the side wall 31, and the gap between the waste developer chamber 30*b* and the side wall 31. Another end of the opening 31*c* can be any shape as long as the waste developer can flow into the waste developer chamber 30*b*. The another opening of the inlet gate 31*a* is preferably in such a shape that the waste developer can enter toward the spiral 34.

The user operates a lever 32*a* to adjust the angular position of the shutter 32 relative to the lower body 30*a*-2 of the developer cartridge 12. The shutter 32 is in one piece construction in its entirety, and has a shape of a cylinder with openings 32*e* and openings 32*d* formed therein. The openings 32*e* are formed such that when the lever 32*a* is pivoted to an opening position (FIG. 8B), the fresh developer chamber 30*a* communicates with the print process cartridge 11 through the openings 32*e* and the openings 32*d*. A shutter element 32*b* is formed with a plurality of openings 32*d* in it. A gear 32*c* is in mesh with a gear 35, which will be described later. The lever 32*a* has a projection at its free end portion for the user to operate the shutter 32. When the user causes the lever 32*a* to pivot about the axis of the shutter element 32*b*, the angular position of the shutter 32 relative to the lower body 30*a*-2 is changed. When the shutter 32 is rotated relative to the lower body 30*a*-2 of the developer chamber 30 to a predetermined angular position, the openings 32*d* are aligned with the openings 30*c* so that the box-shaped developer chamber 30*a* communicates with the print process cartridge 11 of the image forming section. In other words, when the shutter 32 takes up a predetermine angular position, the fresh developer chamber 30*a* communicates with the print process cartridge 11 through the opening 32*e*, opening 32*d*, and opening 30*c*, so that the fresh developer is discharged from the fresh developer chamber 30*a* into the print process cartridge 11 through the opening 30*c*.

Figure 9A:
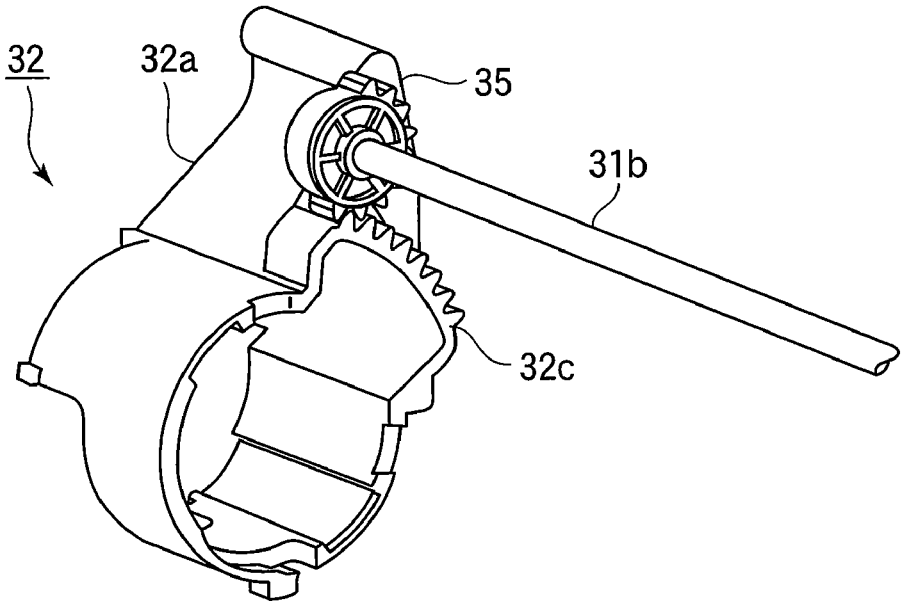
FIGS. 9A and 9B are perspective views illustrating a gear of a lever and another gear of the developer cartridge.

The inlet open/close member 33 includes a cap 33*a* and a shaft 33*b*, and is rotatable about the shaft 33*b* in the waste developer chamber 30*b*. The cap 33*a* and the shaft 33*b* may be either in one piece with each other or separate parts. The cap 33*a* is in the shape of a short hollow cylinder with its one end closed, and closes one end of the inlet gate 31*a* from the inside of the waste developer chamber 30*b*. The cap 33*a* has a cutout 33*c* formed in its circumferential wall, the cutout 33*c* circumferentially extending along a ¼ of the entire circumference. The cutout 33*c* is to control the flow of the waste developer through the inlet gate 31*a*. That is, when the cutout 33*c* overlaps the opening 31*c* at least partially, the waste developer is allowed to flow into the waste developer chamber 30*b* through the cutout 33*c*. When the cutout 33*c* and the opening 31*c* are not alignment or not overlapped each other, the waste developer does not flow into the waste developer chamber 30*b*. The cap 33*a* has an inner diameter slightly larger than an outer diameter of the inlet gate 31*a*. The shaft 33*b* has one end fixed to the center of the circular bottom wall of the cap 33*a* and another end fixed to the gear 35, and extends through the developer cartridge 12. The cap 33*a* fits over the inlet gate 31*a* of the side wall 31. The gear 35 is in mesh with the gear 32*c* so that when the user operates the lever 32*a*, the gear 32*c* causes the gear 35 to rotate (FIG. 9A).

Figure 6:
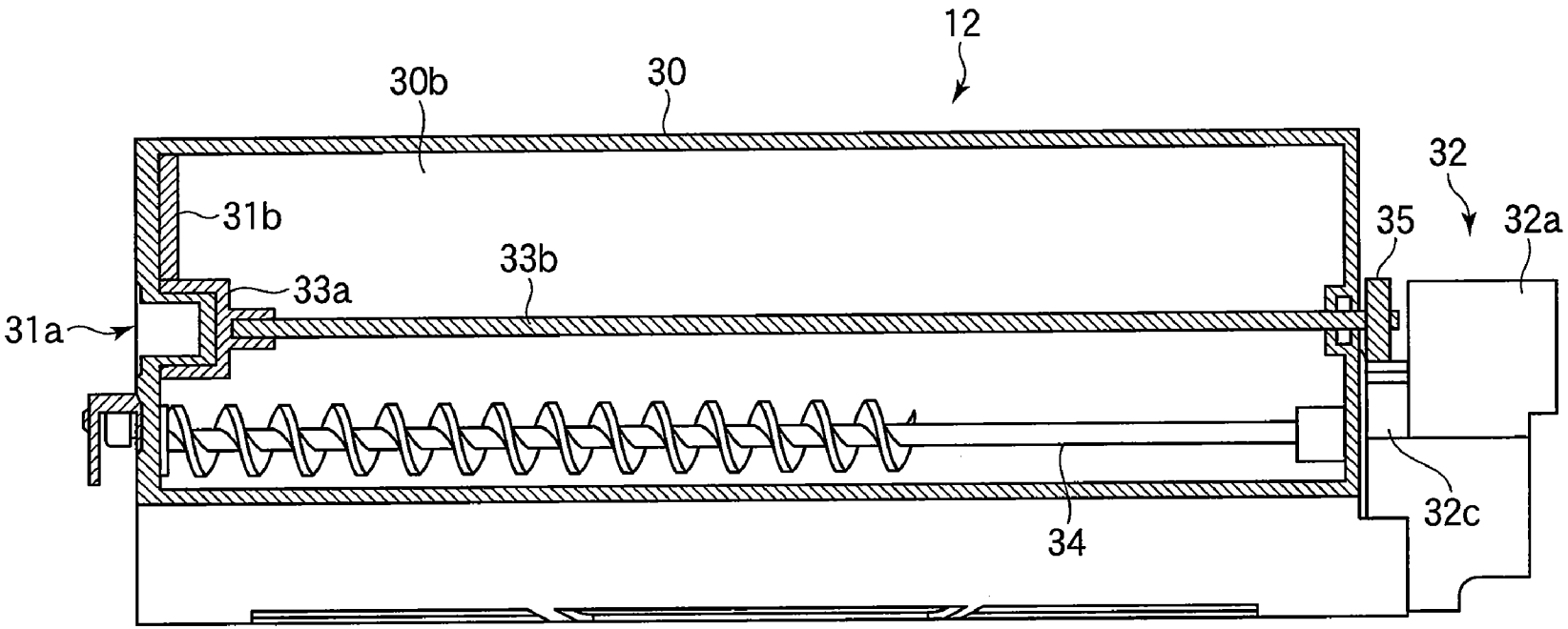
FIG. 6 is a cross-sectional side view of the developer cartridge.

FIG. 6 is a cross-sectional side view of the developer cartridge 12.

Referring to FIG. 6, the cap 33*a* fits over the inlet gate 31*a*. When the rotation of the shutter 32 is transmitted to the inlet open/close member 33 via the gear 35 and the gear 32*c*, the cap 33*a* rotates about the shaft 33*b* to open or close the opening 31*c*.

Figure 7A:
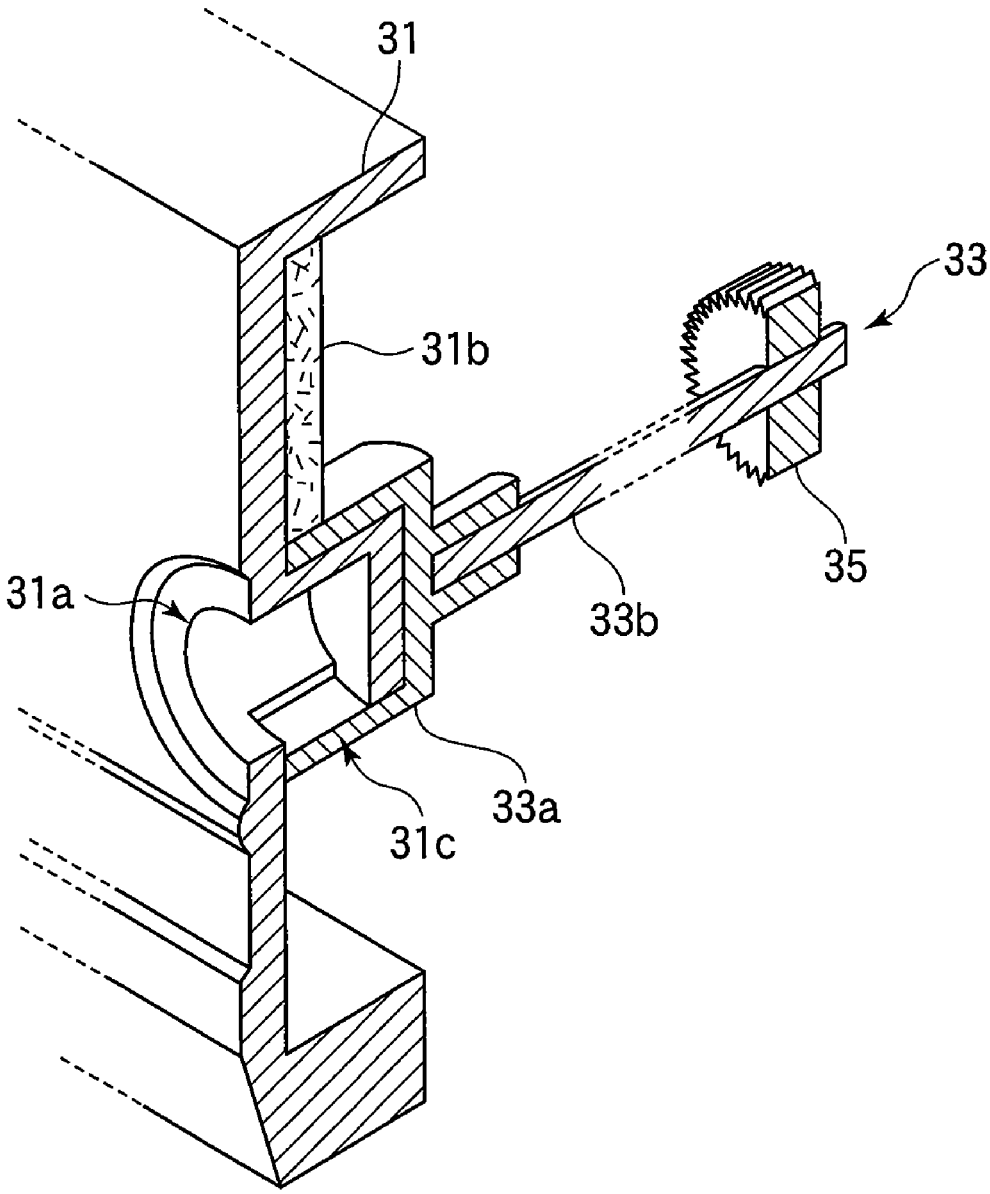
FIGS. 7A and 7B are cross-sectional views taken along a line X-X' of FIG. 4.
Figure 7B:
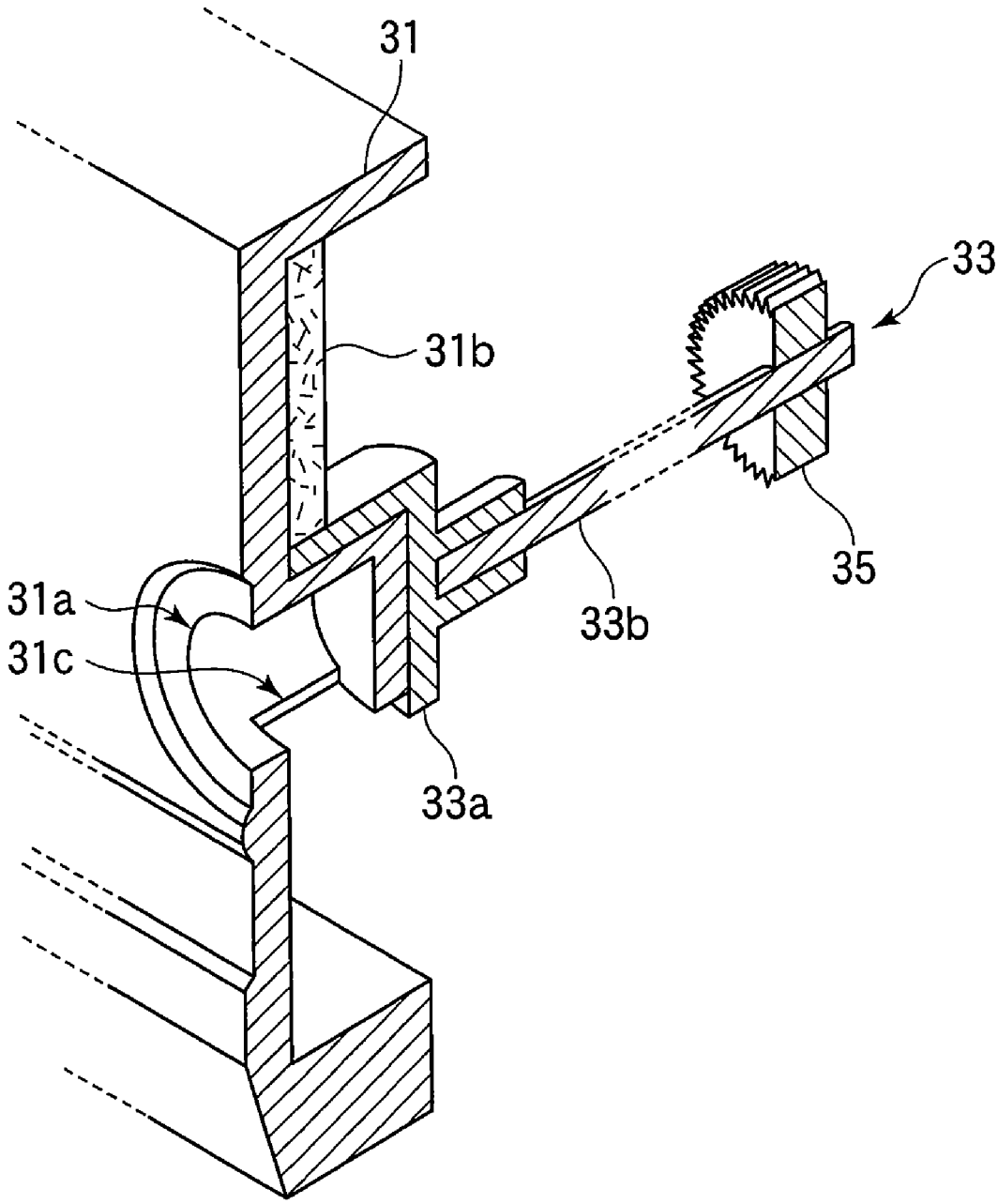

FIGS. 7A and 7B are cross-sectional views taken along a line X-X' of FIG. 4 illustrating the opening and closing of the opening 31*c*. The opening 31*c* is opened when the cutout 33*c* in the cap 33*a* and the opening 31*c* are in alignment with each other or are overlapped each other as shown in FIG. 7A. The opening 31*c* is not opened when the cutout 33*c* in the cap 33*a* and the opening 31*c* are not in alignment with each other or are not overlapped each other as shown in FIG. 7B. In other words, the user operates the lever 32*a* to rotate the inlet open/close member 33, thereby opening and closing the opening 31*c*.

The spiral 34 extends in a longitudinal direction of the waste developer chamber 30*b*, and transports the waste developer from a near end toward the far end in the waste developer chamber 30*b*.

{Operation}

Figure 8A:
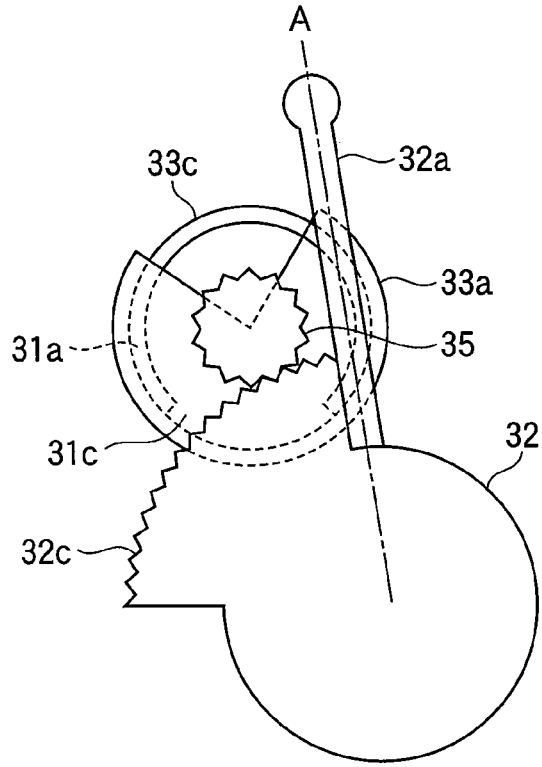
FIG. 8A illustrates a discharging opening when it is closed.

FIG. 8A illustrates the positional relation between the cutout 33*c* in the cap 33*a* and opening 31*c* in the inlet gate 31*a* when the cap 33*a* closes the opening 31*c*.

Figure 8B:
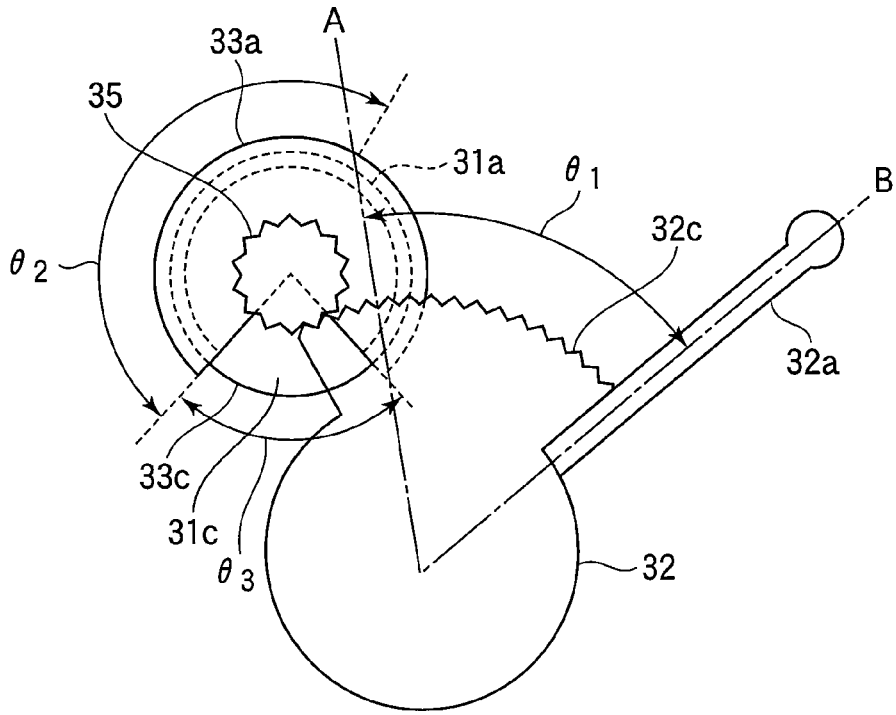
FIG. 8B illustrates the discharging opening when it is opened.
Figure 8C:
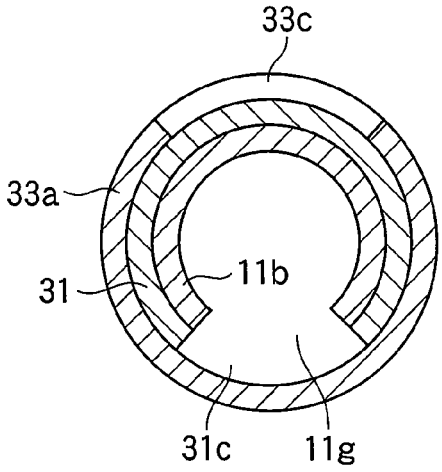
FIG. 8C is a cross-sectional view taken along a line 8C-8C of FIG. 8D.
Figure 8D:
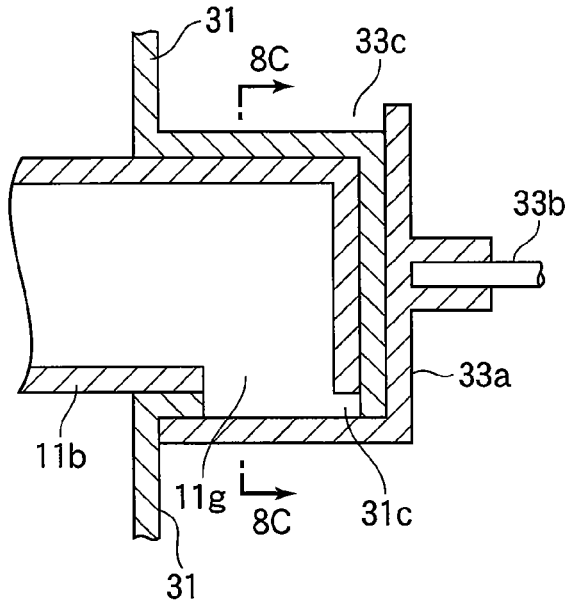
FIG. 8D is a cross-sectional view illustrating a cap, an opening in an inlet gate, and a discharging cylinder when the cap closes the opening.

FIG. 8C is a cross-sectional view taken along a line 8C-8C of FIG. 8D.

FIG. 8D is a cross-sectional view illustrating the cap 33*a*, opening 31*c* in the inlet gate 31*a*, and discharging cylinder 11*b* when the cap 33*a* closes the opening 31*c*.

At this moment, the lever 32*a* is at position A (FIG. 8A) and the cutout 33*c* oriented upward so that the cap 33*a* closes opening 31*c*. The shutter element 32*b* of the shutter 32 closes the fresh developer chamber 30*a*.

FIG. 8B illustrates the positional relation between the cutout 33*c* in the cap 33*a* and opening 31*c* in the inlet gate 31*a* when the cap 33*a* opens the opening 31*c*.

Figure 8E:
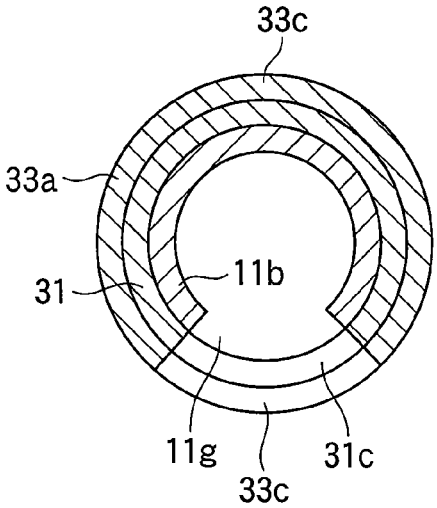
FIG. 8E is a cross-sectional view taken along a line 8E-8E of FIG. 8F.
Figure 8F:
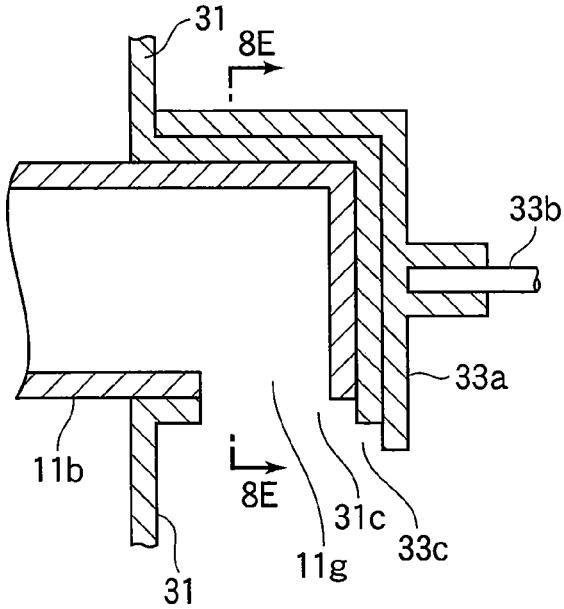
FIG. 8F is a cross-sectional view illustrating the cap, opening in the inlet gate, and discharging cylinder when the cap closes the opening.

FIG. 8E is a cross-sectional view taken along a line 8E-8E of FIG. 8F.

FIG. 8F is a cross-sectional view illustrating the cap 33*a*, opening 31*c* in the inlet gate 31*a*, and discharging cylinder 11*b* when the cap 33*a* opens the opening 31*c*.

Referring to FIG. 8B, the lever 32*a* has pivoted through an angle θ1 from position A (FIG. 8A) to position B. As the lever 32*a* is pivoted from position A to position B, the shutter element 32*b* also rotates so that the openings 32*d* move into alignment with the discharging opening 30*c* and the openings 32*e* move to face the inner space of the fresh developer chamber 30*a*. The gear 32*c* also rotates through the angle θ1 causing the gear 35 to rotate so that the cap 33*a* rotates about the shaft 33*b* through an angle θ2. The rotation of the cap 33*a* causes the cutout 33*c* to face downward so that the cap 33*a* opens the opening 31*c*. The number of teeth of the gear 32*c* and the number of teeth of the gear 35 are related such that $\theta 2=\theta 1\times(Z1/Z2)$ where Z1 is the number of teeth of the gear 32*c* for its one complete circumference and Z2 is the number of teeth of the gear 35 for its one complete circumference, and θ2 is the angular rotation of the cutout 33*c*. This relation ensures that the rotation of inlet open/close member 33 completely closes and opens the discharging opening 31*c*, and allows the user to know the opening angle θ3 of the opening 31*c* in terms of the rotation amount of the shutter 32. The angle θ3 is selected to be in the range of $\theta 3<180$ and $\theta 3<\theta 2$. The angle θ3 and the size of the discharging opening 30*c* may be selected as long as the aforementioned opening and closing of the opening 31*c* is accomplished.

{Example of Gears}

Figure 9B:
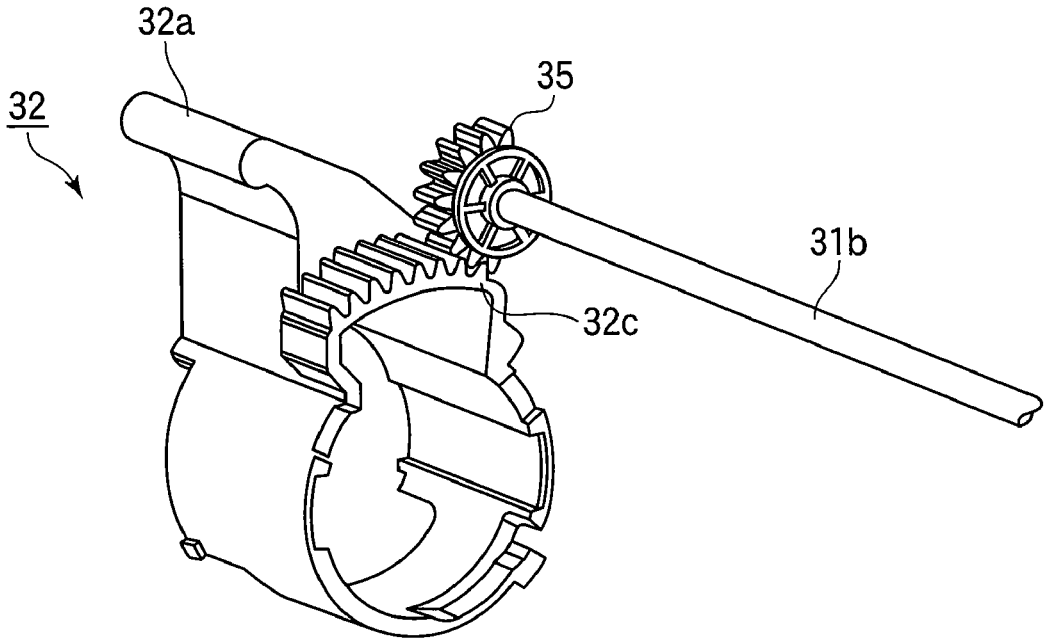

FIGS. 9A and 9B are perspective views illustrating a specific example of the gear 32*c* of the lever 32*a* and the gear 35.

It is preferable that each of the gears 32*c* and 35 has a minimum number of teeth, i.e., as many teeth as the two gears actually mesh each other. Referring to FIGS. 9A and 9B, the gears 32*c* and 35 are formed with predetermined numbers of teeth such that the aforementioned relation is achieved. Specifically, the number of teeth of the gear 32*c* is selected to be $Z1'=Z1\times(\theta 1/360)$. Then, the gears 32*c* and 35 having such numbers of teeth are manufactured. The gears 32*c* and gears 35 are brought into meshing engagement with each other such that the cutout 33*c* is not aligned with the opening 31*c* when the lever 32*a* is at position A, and such that the cutout 33*c* is aligned with the opening 31*c* when the lever 32*a* is at position B.

{Attachment of Cartridge}

The developer cartridge 12 of the aforementioned configuration operates as follows.

Before the operator breaks the seal of the package, the lever 32*a* is at position A in FIG. 8A. In other words, the cutout 33*c* is oriented upward so that the waste developing chamber 30*b* is closed completely. Referring to FIG. 3, the user attaches the developer cartridge 12 to the print process cartridge 11 in such a way that the discharging cylinder 11*b* of the print process cartridge 11 enters the inlet gate 31*a* of the developer cartridge 12. As the discharging cylinder 11*b* enters the inlet gate 31*a*, the lid 11*c* slides along the discharging cylinder 11*b* to open a discharging opening 11*g* (FIG. 8C, FIG. 8E) formed in the discharging cylinder 11*b*.

Referring back to FIG. 8B, the user rotates the lever 32*a* through the angle θ1. The rotation of the lever 32*a* through the angle θ1 causes the shutter 32 to rotate so that the fresh developer chamber 30*a* communicates with the print process cartridge 11 through the opening 32*d* and opening 32*e*. As a result, the fresh developer flows from the fresh developer chamber 30*a* into the print process cartridge 11. At this moment, the rotation of the gear 35 causes the shaft 33*b* and the cap 33*a* to rotate so that the cutout 33*c* rotates through the angle θ2 to the position in FIG. 8B, opening the opening 31*c*. This causes the discharging cylinder 11*b* to communicate with the waste developer chamber 30*b* through the opening 31*c*, allowing the waste developer to fall into the waste developer chamber 30*b*.

{Detachment of Cartridge}

A description will now be given of the operation in which the user detaches the developer cartridge 12 from the print process cartridge. First, the user rotates the lever 32*a* through the angle θ1 from position B in FIG. 8B back to the original position A in FIG. 8A. The pivotal movement of the lever 32*a* through the angle θ1 causes the cap 33*a* to rotate, the cutout 33*c* being oriented upward so that the fresh developer chamber 30*a* no longer communicates with the print process cartridge 11 through the openings 32*d*, 32*e*, and 30*c*. The rotation of the lever 32*a* causes the shaft 33*b* and the cap 33*a* to rotate so that the cutout 33*c* is oriented upward. Thus, the upward orientation of the cutout closes the opening 31*c*, so that the waste developer chamber 30*b* no longer communicates with the discharging cylinder 11*b*. Then, the user tilts the developer cartridge 12 at an angle and draws the developer cartridge 12 from the discharging cylinder 11*b* of the print process cartridge 11.

Because the waste developer chamber 30*b* is completely closed before it is taken out from the print process cartridge 11, spillage of the waste developer is prevented. Specifically, operating the lever 32*a* in one direction allows the fresh developer to flow from the fresh developer chamber into the print process cartridge 11, and operating the lever 32*a* in the opposite direction causes the opening 31*c* of the waste developer chamber 30*b* to close. This operation prevents spillage of the waste developer from the developer cartridge 12 without imposing complicated operation on the user when the developer cartridge 12 is taken out of the print process cartridge 11.

Second Embodiment

An image forming apparatus 40 according to a second embodiment has the same configuration as that according to the first embodiment. Elements similar to those in the first embodiment have been given the same reference numerals and the description of the same elements and configuration as the first embodiment is omitted. Therefore, a description will be given of the configuration different from that of the first embodiment.

Figure 10:
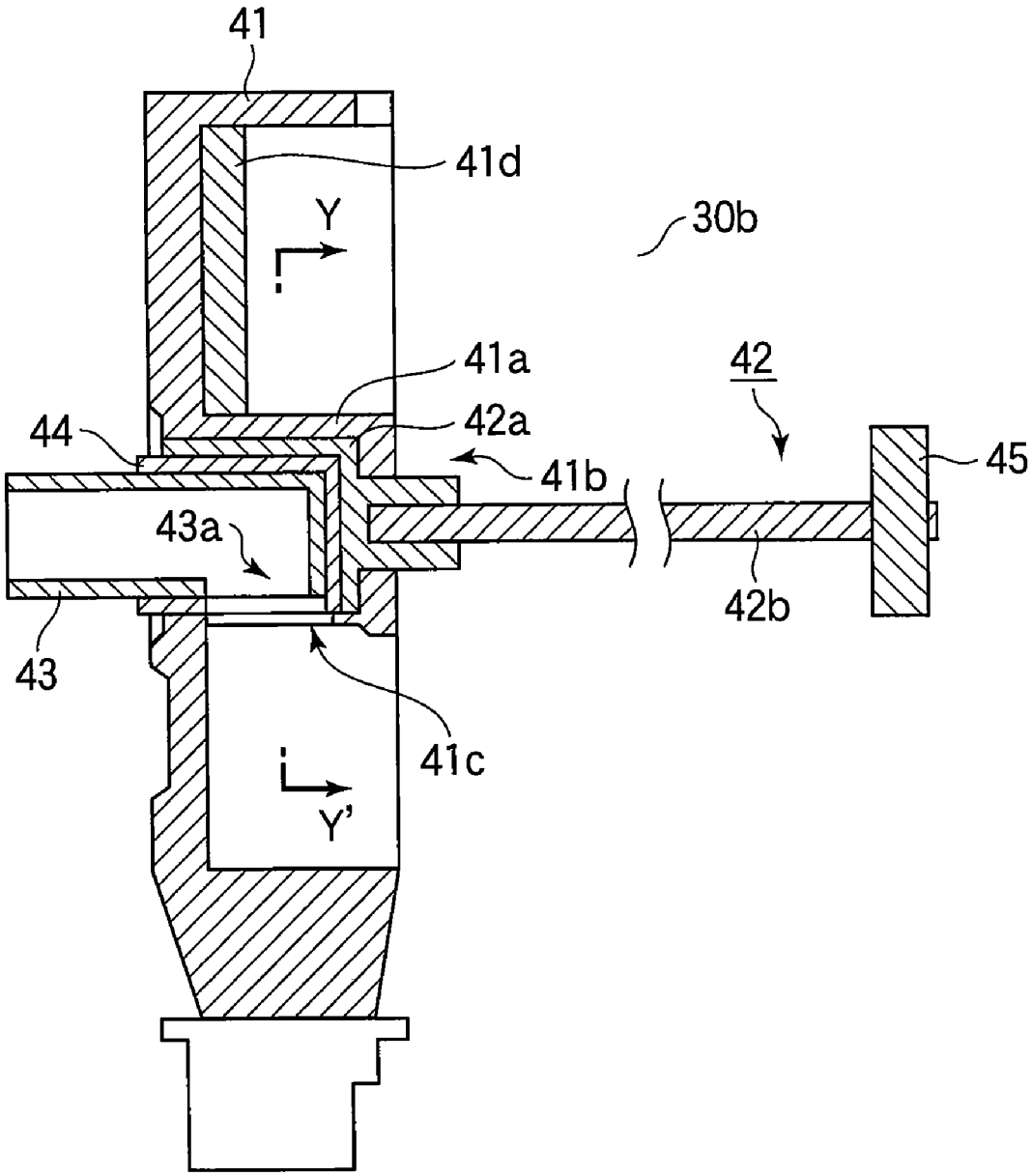
FIG. 10 is a cross sectional view of a side wall that closes one longitudinal end of a developer cartridge according to a second embodiment, illustrating a discharging cylinder and a inlet open/close member.

FIG. 10 is a cross sectional view of a sidewall 41 that closes one longitudinal end of a developer cartridge 12 according to the second embodiment, illustrating a discharging cylinder 43 and a cap 42*a*.

Figure 11:
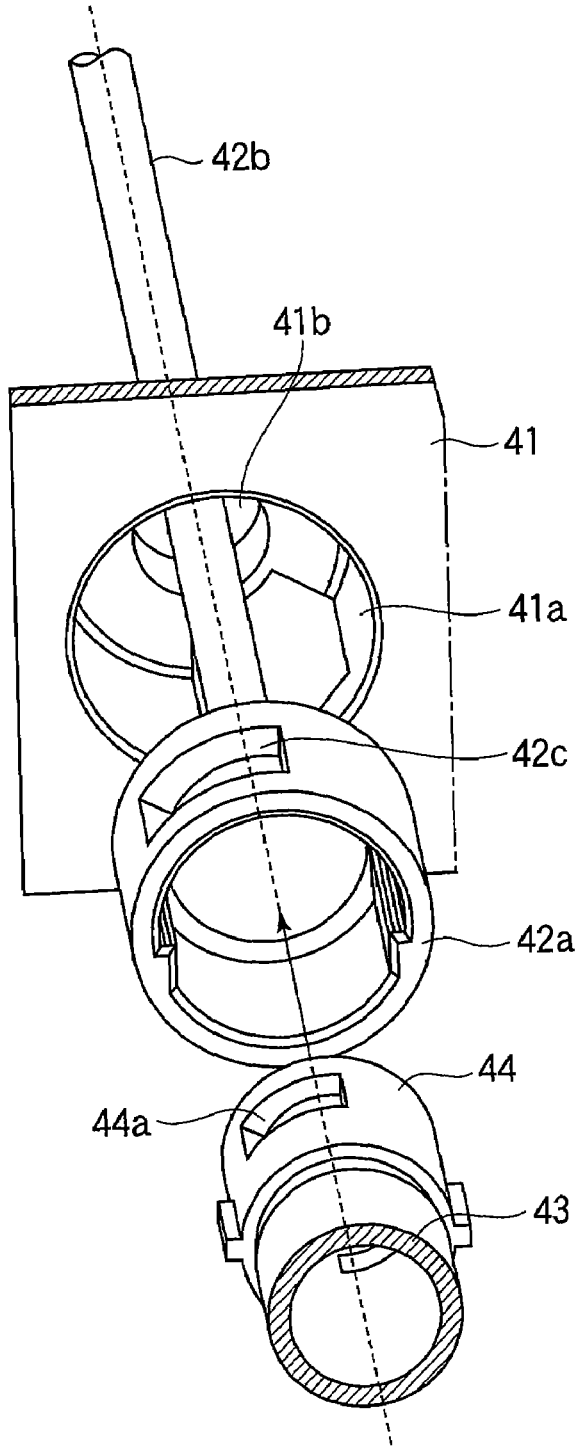
FIG. 11 is an exploded perspective view as seen from a print process cartridge, illustrating a discharging cylinder, a lid, inlet open/close member, and the side wall.

FIG. 11 is an exploded perspective view as seen from a print process cartridge 11, illustrating the discharging cylinder 43, a cylindrical lid 44, an inlet open/close member 42, and the side wall 41.

Referring to FIG. 10, the side wall 41 includes a cylindrical recess 41*a* having a circumferential wall in which an opening 41*b* is formed. The side wall 41 is attached to one longitudinal end of the developer cartridge 12 with a sealing member 41*d* sandwiched between the developer cartridge 12 and the side wall 41. The sealing member 41*d* provides a sealing between the side wall 41 and the fresh developer chamber, not shown and a sealing between the side wall 41 and the waste developer chamber 30*b*. The cylindrical recess 41*a* receives the cap 42*a* in the shape of a short hollow cylinder with its one end closed. The cap 42*a* loosely fits into the cylindrical recess 41*a* and extends through the opening 41*b* into the interior of the waste developer chamber 30*b*. The cap 42*a* has a cutout 41*c* formed in its circumferential wall of the cap 42*a*, the cutout 41*c* circumferentially extending along a ¼ of the entire circumference. A discharging cylinder 43 of the print process cartridge 11 is closed at its one end and has an opening 43*a* formed in its circumferential wall in the vicinity of the closed end. Another short cylinder 44 has an opening 44*a* formed in its circumferential wall. The cylinder 44 fits over the discharging cylinder 43, and fittingly enters the cylindrical space of the cap 42*a*. The cylindrical recess 41*a* has an opening 41*c* formed in its circumferential inner surface into which waste developer flows from the discharging cylinder 43.

The inlet open/close member 42 includes the cap 42*a* and a shaft 42*b*, and extends across the length of the waste developer chamber 30*b*. The inlet open/close member 42 is rotatable about the shaft 42*b*. The cap 42*a* and the shaft 42*b* may be either in one piece with each other or separate parts. The cap 42*a* is in the shape of a short hollow cylinder with its one end closed. The cap 42*a* has a cutout 42*c* formed in its circumferential wall, the cutout 42*c* circumferentially extending along a ¼ of the entire circumference. The cutout 42*c* is to restrict the flow of the waste developer through the inlet gate 43 into the waste developer chamber 30*b*. When the inlet open/close member 42 rotates so that the cutout 42*c* and the opening 43*a* are aligned with each other or are overlapped each other, the waste developer is introduced into the waste developer chamber 30*b*.

When the inlet open/close member 42 rotates so that the cutout 42*c* and the opening 43*a* are not aligned or are not overlapped each other, the waste developer is not introduced into the waste developer chamber 30*b*. The cap 42*a* has an outer diameter slightly smaller than an inner diameter of the cylindrical recess 41*a*. The cap 42*a* has an inner diameter slightly larger than an outer diameter of the short cylinder 44. The shaft 42*b* has one end fixed to the center of the cap 42*a* and another end fixed to the center of a gear 45 that drives the inlet open/close member 42 in rotation from outside of the developer cartridge 12.

The discharging cylinder 43 is a hollow cylinder through which the waste developer is supplied from the print process cartridge 11, not shown, into the waste developer chamber 30*b* of the developer cartridge 12.

Figure 12A:
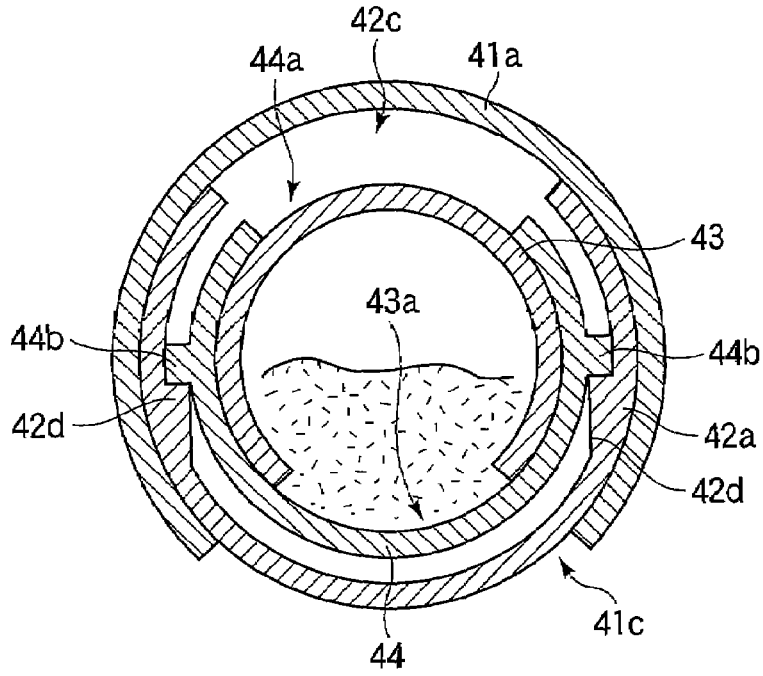
FIG. 12A is a cross-sectional view taken along a line Y-Y' of FIG. 10.

FIG. 12A is a cross-sectional view illustrating the discharging cylinder 43, short cylinder 44, and cap 42*a* when the discharging cylinder 43 is not in communication with the waste developer chamber 30*b*.

When the discharging cylinder 43 and short cylinder 44 enter the cylindrical recess 41*a*, the short cylinder 44 is closing the opening 43*a*. The short cylinder 44 includes diametrically opposite projections 44*b* that engage the abutments 42*d* formed on the inner surface of the cap 42*a*.

Figure 12B:
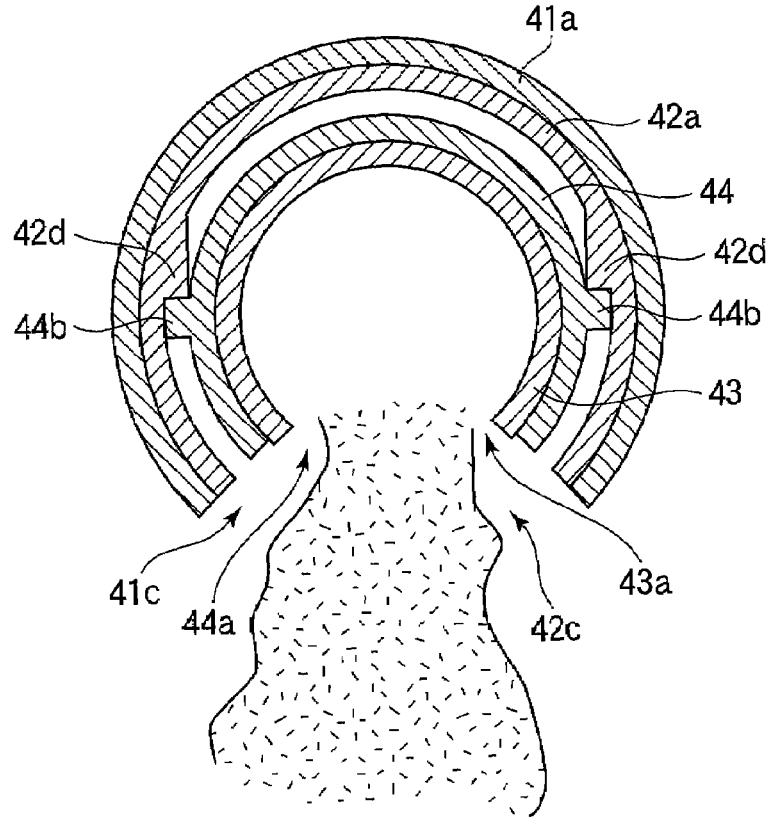
FIG. 12B illustrates the discharging cylinder, a short cylinder and a cap when the discharging cylinder is in communication with a waste developer chamber.

FIG. 12B is a cross sectional view taken along a line Y-Y' of FIG. 10 illustrating the discharging cylinder 43, short cylinder 44, and cap 42*a* when the discharging cylinder 43 is in communication with the waste developer chamber 30*b*.

When a user operates a shutter, not shown, to pivot from a closing position to an opening position, the inlet open/close member 42 rotates so that the cap 42*a* and the short cylinder 44 rotate together from the position in FIG. 12A to the position in FIG. 12B. Referring to FIG. 12B, the cutout 42*c*, opening 44*a*, and cutout 41*c* are aligned with the opening 43*a* so that the waste developer is introduced into the waste developer chamber 30*b*. By using the same procedure as the first embodiment, the fresh developer may be discharged from the fresh developer chamber into the print process cartridge 11 and the waste developer may be received from the print process cartridge 11 into the waste developer chamber 30*b*.

The engagement of the projections 44*b* with the abutments 42*d* eliminates a spring that urges the short cylinder 44.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer cartridge that holds developer, the developer cartridge comprising:

a fresh developer chamber that holds fresh developer;

a waste developer chamber that holds waste developer;

an inlet formed in said waste developer chamber, the waste developer being received through said inlet into said waste developer chamber;

a first opening-and-closing member that opens and closes said inlet; and a mechanism that drives said first opening-and-closing member to open and close said inlet;

an opening formed in the fresh developer chamber through which the fresh developer is discharged from the fresh developer chamber; and a second opening-and-closing member that opens and closes said opening;

wherein said mechanism causes said second opening-and-closing member and said first opening-and-closing member to open and close in an interlocked relation.

2. The developer cartridge according to claim 1 further comprising an operating member operated by a user;

wherein said mechanism operates in such a way that said first and second opening-and-closing members close said inlet and said opening, respectively, when said operating member is at a closing position, and that said first and second opening-and-closing members open said inlet and said opening, respectively, when said operating member is at an opening position.

3. The developer cartridge according to claim 1, wherein said mechanism causes said first opening-and-closing member to rotate through an angle about an axis when said mechanism drives said first opening-and-closing member.

4. The developer cartridge according to claim 3, wherein said first opening-and-closing member includes a shaft, a gear attached to one end of the shaft, and a cap attached to another end of the shaft, wherein said mechanism transmits a drive force to the gear to drive said first opening-and-closing member in rotation about the shaft.

5. The developer cartridge according to claim 4, wherein the gear includes teeth formed in a part of a circumferential surface of the gear.

6. The developer cartridge according to claim 1, wherein said second opening and closing member comprises an operating member, wherein when said operating member is operated to an opening position, said mechanism causes said first opening and closing member to open the inlet and said second opening and closing member to open the outlet such that the inlet and the outlet are opened in the interlocked relation.

7. The developer cartridge according to claim 6, wherein when said operating member is operated to a closing position, said mechanism causes said first opening and closing member to close the inlet and said second opening and closing member to close the outlet such that the inlet and the outlet are closed in the interlocked relation.

8. The developer cartridge according to claim 7, wherein said mechanism operates in such a way that said first and second opening and closing members close said inlet and said opening, respectively, when said operating member is at a closing position, and that said first and second opening and closing members open said inlet and said opening, respectively, when said operating member is at an opening position.

9. The developer cartridge according to claim 1, wherein said second opening and closing member comprises an operating member, wherein when said operating member is operated to a closing position, said mechanism causes said first opening and closing member to close the inlet and said second opening and closing member to close the outlet such that the inlet and the outlet are closed in the interlocked relation.

10. A print process cartridge that forms an electrostatic latent image on an image bearing body and then develops the electrostatic latent image into a developer image, the print process cartridge comprising:

a developer cartridge including a fresh developer chamber that holds fresh developer and a waste developer chamber that holds waste developer;

a transporting mechanism that transports waste developer removed from the image bearing body;

a waste developer discharging port through which the waste developer is supplied from said transporting mechanism into the waste developer chamber;

wherein said developer cartridge comprises:

an inlet formed in the waste developer chamber, the waste developer being received into the waste developer chamber through said inlet;

a first opening-and-closing member that opens and closes said inlet;

a mechanism that drives said first opening-and-closing member to open and close said inlet;

an opening formed in the fresh developer chamber through which the fresh developer is discharged from the fresh developer chamber; and a second opening and closing member that opens and closes said opening;

wherein said mechanism causes said second opening and closing member and said first opening and closing member to open and close in an interlocked relation.

11. An image forming apparatus that incorporating the print process cartridge according to claim 10.

* * * * *